US009343000B2

(12) United States Patent
Stadjuhar

(10) Patent No.: US 9,343,000 B2
(45) Date of Patent: May 17, 2016

(54) FINE PITCH FULL COLOR VARIABLE MESSAGE SIGN

(75) Inventor: Robert Charles Stadjuhar, Colorado Springs, CO (US)

(73) Assignee: Skyline Products, Inc., Colorado Springs, CO (US)

( * ) Notice: Subject to any disclaimer, the term of this patent is extended or adjusted under 35 U.S.C. 154(b) by 0 days.

(21) Appl. No.: 12/888,241

(22) Filed: Sep. 22, 2010

(65) Prior Publication Data

US 2012/0066944 A1 Mar. 22, 2012

(51) Int. Cl.
*G09F 13/00* (2006.01)
*G09F 9/33* (2006.01)
*G09F 19/22* (2006.01)

(52) U.S. Cl.
CPC *G09F 9/33* (2013.01); *G09F 13/00* (2013.01); *G09F 19/22* (2013.01)

(58) Field of Classification Search
CPC ..... G09F 13/04; G09F 13/00; G09F 13/14; G09F 13/28; F21S 10/02
USPC ..... 40/581
See application file for complete search history.

(56) References Cited

U.S. PATENT DOCUMENTS 4,970,812 A * 11/1990 Tanaka et al. ..... 40/452
5,388,035 A * 2/1995 Bodem, Jr. ..... 362/545
5,715,619 A * 2/1998 Polisois et al. ..... 40/452
6,364,507 B1 * 4/2002 Yang ..... 362/248
6,379,209 B1 * 4/2002 Tucker ..... 445/24
6,677,918 B2 * 1/2004 Yuhara et al. ..... 345/1.3
6,741,222 B1 * 5/2004 Tucker ..... 345/1.1
7,284,881 B2 * 10/2007 Kim et al. ..... 362/290
7,559,673 B2 * 7/2009 Meersman et al. ..... 362/245
2003/0058191 A1 * 3/2003 Yuhara et al. ..... 345/44
2004/0123501 A1 * 7/2004 Safavi et al. ..... 40/452
2006/0279493 A1 * 12/2006 Syrstad ..... 345/82
2007/0008259 A1 * 1/2007 Barker ..... 345/84
2008/0098634 A1 * 5/2008 Stadjuhar ..... 40/605
2008/0120880 A1 * 5/2008 Stadjuhar ..... 40/624
2008/0141570 A1 * 6/2008 Nearman et al. ..... 40/574
2008/0225143 A1 * 9/2008 Joffer et al. ..... 348/280
2008/0266206 A1 * 10/2008 Nelson et al. ..... 345/1.3
2011/0051409 A1 * 3/2011 Nearman ..... 362/231

* cited by examiner

*Primary Examiner* — Cassandra Davis
(74) *Attorney, Agent, or Firm* — Bryan Cave LLP

(57) ABSTRACT

A fine pitch full color variable message sign has a housing with a front face. A number of printed circuit boards are arranged along the front face of the housing. A number of LEDs are attached to each of the printed circuit boards. The LEDs are grouped into a number of pixels, each pixel has three LEDs arranged in a line. A mask covers the printed circuit boards. The mask has a number of elliptical apertures. A glazing may cover the printed circuit boards and is between the printed circuit boards and the mask. Each pixel has three LEDs; red, blue, and green. The LEDs that form a pixel are arranged in a line. The elliptical apertures are aligned with each pixel.

22 Claims, 5 Drawing Sheets

FINE PITCH FULL COLOR VARIABLE MESSAGE SIGN

BACKGROUND OF THE INVENTION

Variable message signs are used to display messages to motorists and provide them information about hazards, accidents ahead, weather information, etc. There has been a push to provide variable message signs that provide more detail and/or are in color. In order to provide finer details variable messages signs need more pixels per square foot and this in turn requires finer pitches between Light Emitting Diodes (LEDs). Unfortunately, present signs having finer pitches between LEDs are subject to higher failure rates because the LEDs are exposed to the elements in order to meet the pitch requirements.

Thus there exists a need for a fine pitch color variable message sign that is easy to manufacture and has a high reliability.

BRIEF SUMMARY OF INVENTION

A fine pitch full color variable message sign that overcomes these and other problems has a housing with a front face. A number of printed circuit boards are arranged along the front face of the housing. A number of LEDs are attached to each of the printed circuit boards. The LEDs are grouped into a number of pixels, each pixel has three LEDs arranged in a line. A mask covers the printed circuit boards. The mask has a number of elliptical apertures. In one embodiment, a glazing covers the printed circuit boards and is between the printed circuit boards and the mask. Each pixel has three LEDs; red, blue, and green. The LEDs that form a pixel are arranged in a line. The elliptical apertures are aligned with each pixel. Structural returns can be run between columns of the printed circuit boards to provide structural support for the printed circuit boards, the glazings, and the mask, because the LEDs are arranged in a line instead of a circle or triangle. In one embodiment the LEDs are surface mounted LEDs with feet that allow the LED to stand up and hold the LED perpendicular to the board during soldering. The feet provide standoff between the LEDs and the printed circuit board avoiding reliability issues due to overheating and manufacturing defects. The LEDs may also be flush mount-surface mount, flush mount—through hole, or standoff—through hole.
The mask provides contrast and some protection from the elements. The glazing protects the LEDs from the elements. Because the LEDs are arranged in a vertical line, which aligns with the driver's line of sight, there is almost no color shift experience by drivers viewing the variable message sign from the side.

DETAILED DESCRIPTION OF THE INVENTION

In summary the invention is a fine pitch full color variable message sign that has a housing with a front face. A number of printed circuit boards are arranged along the front face of the housing. A number of LEDs are attached to each of the printed circuit boards. The LEDs are grouped into a number of pixels, each pixel has three LEDs arranged in a line. A mask covers the printed circuit boards. The mask has a number of elliptical apertures. In one embodiment, a glazing covers the printed circuit boards and is between the printed circuit boards and the mask. Each pixel has three LEDs; red, blue, and green. The LEDs that form a pixel are arranged in a line. The elliptical apertures are aligned with each pixel. Structural returns can be run between columns of the printed circuit boards to provide structural support for the printed circuit boards, the glazings, and the mask, because the LEDs are arranged in a line instead of a circle or triangle. The LEDs are surface mounted LEDs with feet. The feet provide standoff between the LEDs and the printed circuit board avoiding reliability issues due to overheating and manufacturing defects. Other types of LEDs such as through hole standoff and surface mount may be used. The mask provides contrast and some protection from the elements. The glazing protects the LEDs from the elements. Because the LEDs are arranged in a vertical line, which aligns with the driver's line of sight, there is almost no color shift experience by drivers viewing the variable message sign from the side.

Figure 1:
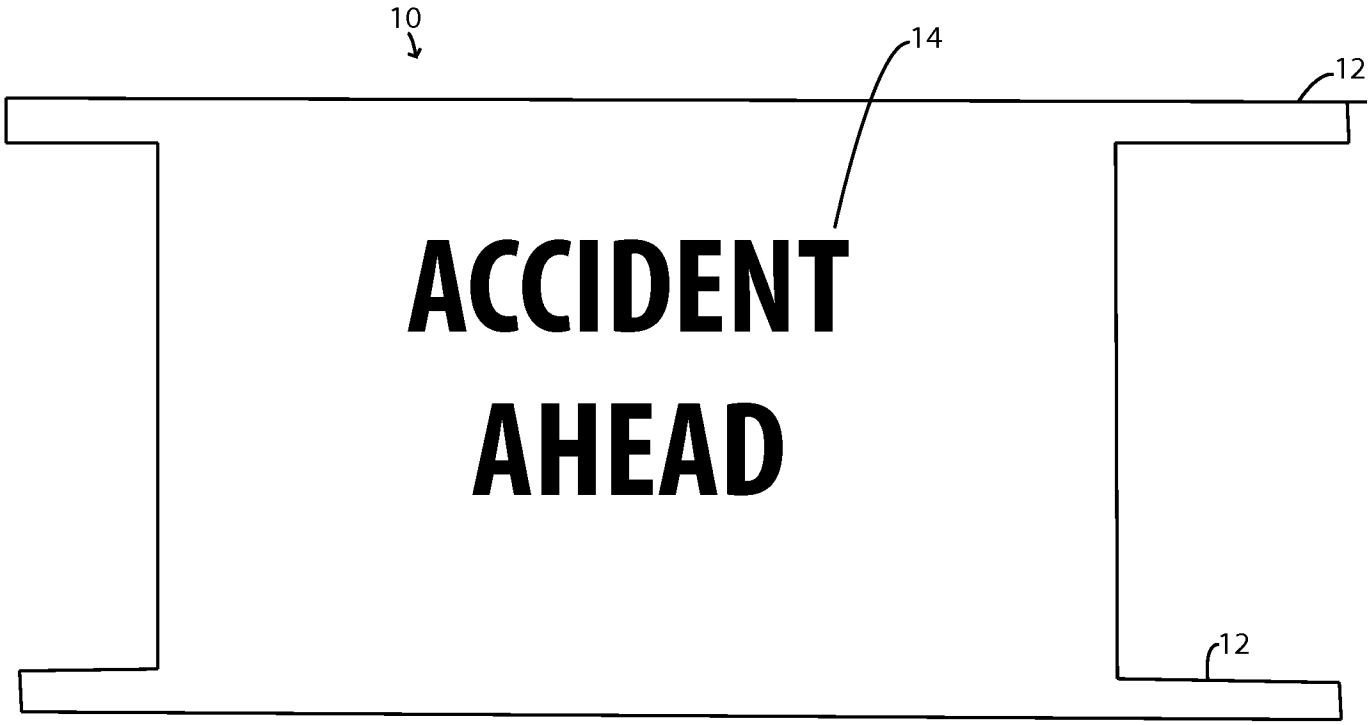
FIG. 1 is a front view of a fine pitch color variable message sign in accordance with one embodiment of the invention.

FIG. 1 is a front view of a fine pitch color variable message sign 10 in accordance with one embodiment of the invention. The sign 10 is shown as a standard highway sign 10 mounted on support beams 12 over a roadway. The sign 10 has a message 14 that warns users of an accident ahead in the roadway.

Figure 2:
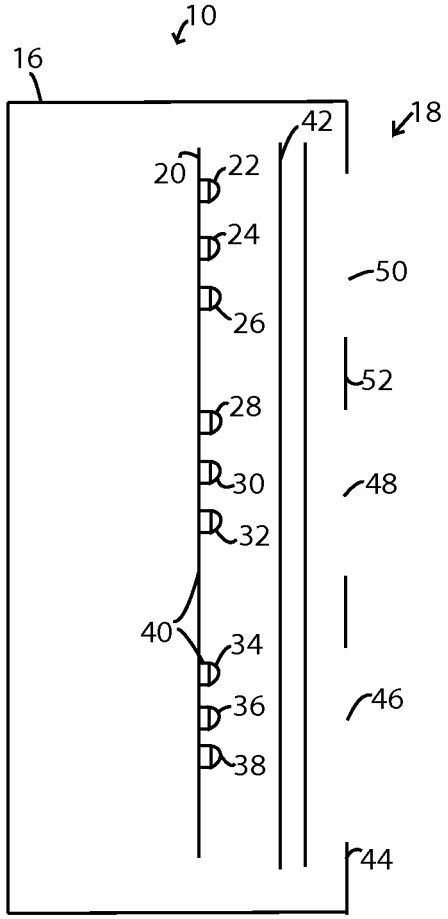
FIG. 2 is a cross sectional side view of a fine pitch color variable message sign in accordance with one embodiment of the invention.

FIG. 2 is a cross sectional side view of a fine pitch color variable message sign 10 in accordance with one embodiment of the invention. The sign has a housing 16 with a front face 18. The sign 10 has a printed circuit board 20. The printed circuit board 20 has a number of LEDs 22, 24, 26, 28, 30, 32, 34, 36, 38. The LEDs 22, 24, 26, 28, 30, 32, 34, 36, 38 are surface mounted LEDs with returns 40 that provide standoff between from a surface of the printed circuit board 20. Adjacent to the printed circuit board 20 is a glazing (glass pane) 42. In front of the glazing 42 is a mask 44. The mask 44 has a plurality of apertures 46, 48, 50 aligned with the LEDs 22, 24, 26, 28, 30, 32, 34, 36, 38. In one embodiment, the glazing 42 is painted or coated to form the mask. Usually, the glazing is painted or coated black when acting as the mask. In another embodiment, the glazing 42 abuts the mask 44. In one embodiment, the mask 44 is an aluminum sheet with a face 52 painted black. The sign 10 may also include a controller and environmental monitoring and control equipment. The environmental control systems include filters that have to be replaced, fans to blow air through the sign and in some cases air conditioners.

Figure 3:
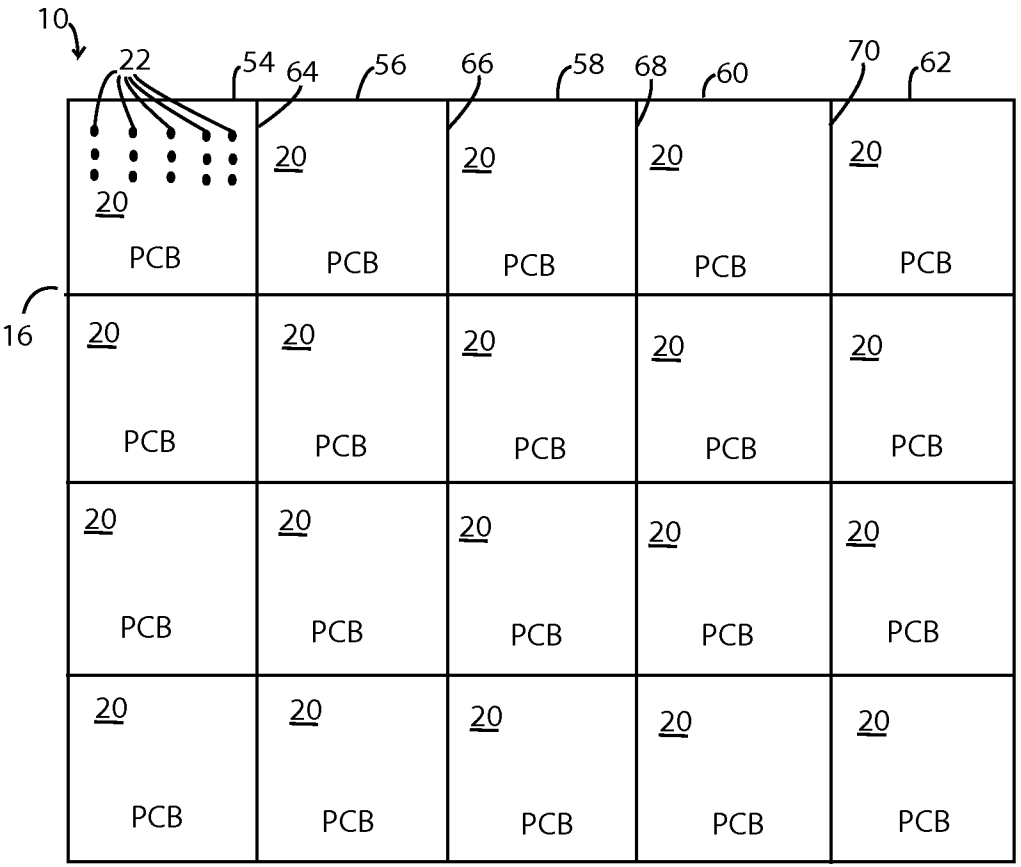
FIG. 3 is a front view of a fine pitch color variable message sign with the mask removed in accordance with one embodiment of the invention.

FIG. 3 is a front view of a fine pitch color variable message sign 10 with the mask removed in accordance with one embodiment of the invention. The sign 10 has five columns of printed circuit boards (PCBs) 20. Each of the PCBs 20 have a plurality of LEDs 22. Between the columns 54, 56, 58, 60, 62 are structural returns 64, 66, 68, 70 that hold the PCBs 20. In one embodiment, there are five glazings for the sign 10 that cover the columns 54, 56, 58, 60, 62.

Figure 4:
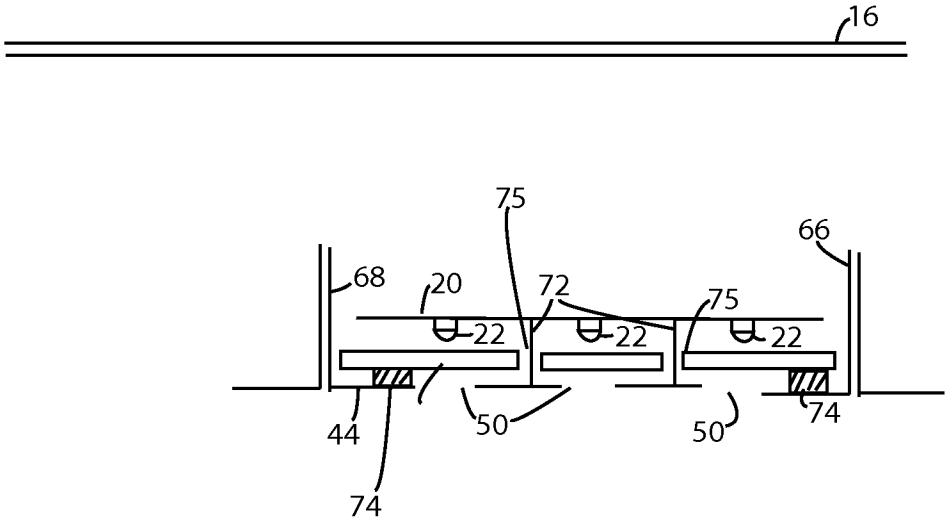
FIG. 4 is a cross sectional partial top view of a fine pitch color variable message sign in accordance with one embodiment of the invention.

FIG. 4 is a cross sectional partial top view of a fine pitch color variable message sign in accordance with one embodiment of the invention. This view shows the printed circuit board 20 is attached to the mask 44 by pins 72. The glazing 42 is attached to mask 44 by a two sided tape 74. The glazing 42 has through holes 75 through which the pins 72 pass. The structural returns 64, 66 are formed by bending the edges of the mask 44 inward, in one embodiment.

Figure 5:
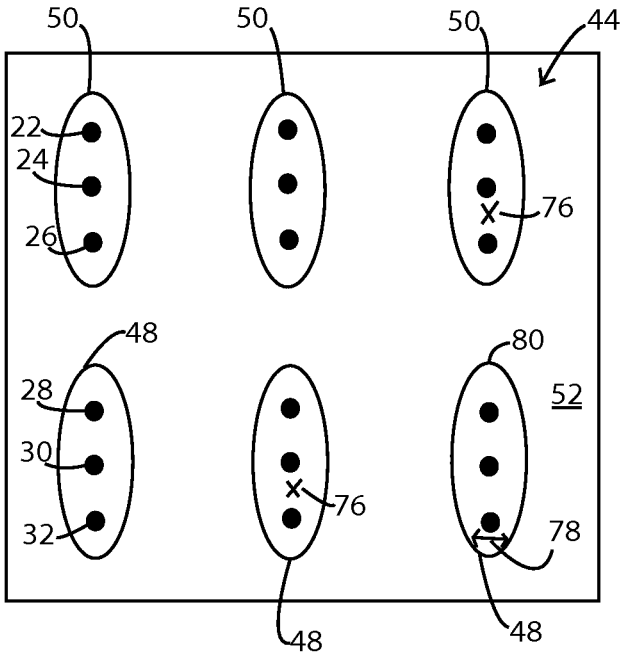
FIG. 5 is partial front view of a mask of a fine pitch color variable message sign in accordance with one embodiment of the invention.

FIG. 5 is partial front view of a mask 44 of a fine pitch color variable message sign in accordance with one embodiment of the invention. The mask 44 has a number of elliptical apertures 48, 50. The apertures 48, 50 are aligned with the LEDs 22, 24, 26, 28, 30, 32. The LEDs 22, 24, 26 form a line segment centered around LED 24 that is vertical when the sign is in place. The center 76 of the ellipse is offset from the center of the line segment formed by the LEDs. Note that in order to provide a full color display a pixel 50 of the sign 10 has a single aperture and has a red, a green, and a blue LED 22, 24, 26. The reason the apertures 48, 50 are elliptical is because the LEDs 22, 24, 26 are in a line. The width 78 of the ellipse is selected to be large enough to encompass at least the full angular width of the light output from the LEDs 22, 24, 26. In one embodiment the LEDs have a 15 degree half width for their output light. The apertures 48, 50 width 78 is sized to be at least as large as this half width. The ellipse is offset from the center 24 of the line segment 22, 24, 26 because the sign is above the motorist. As a result, the motorist viewing angle is such that an ellipse that did not cut off their view either has to be offset from the center 24 of the line segment 22, 24, 26 or larger. A larger ellipse would provide less contrast than a smaller but offset ellipse. Because the ellipse is offset, it is possible that the top 80 of the ellipse may impede the cone of light from the top LED 22, 28. However, a motorist will never be viewing the sign from this angle so it has no affect on the usefulness of the sign. The ellipse provides room for returns and allows the face to be manufacturable.

Thus there has been described a fine pitch color variable message sign that is easy to manufacture and has high reliability.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A fine pitch full color variable message sign, comprising:

a mask having a plurality of openings, wherein the plurality of openings have a major axis that is not equal to a minor axis;

a glazing adjacent to the mask and located between the mask and a plurality of printed circuit boards;

the plurality of printed circuit boards adjacent to the glazing, each of the plurality of printed circuit boards having a plurality of pixels, wherein each pixel includes a red LED, a green LED, and a blue LED, wherein the red LED, the green LED, and the blue LED of one of the plurality of pixels are arranged along a line, wherein each pixel is aligned at a different one of the plurality of openings such that the red LED, the green LED, and the blue LED of the same pixel are aligned to the same opening;

a structural return having a first end attached to the mask;

one or more pins having a first pin end attached to the mask; and a housing attached to the mask;

wherein:

the glazing obstructs access to the plurality of printed circuit boards from a front of the sign by covering the plurality of printed circuit boards;

each of the one or more pins extend from the mask and through the glazing; and the one or more pins have a second pin end attached to at least one of the plurality of printed circuit boards.

2. The sign of claim 1, wherein the mask does not abut the glazing.

3. The sign of claim 1, wherein a center of one of the plurality of openings is offset from a midpoint of the line formed by the red LED, the green LED, and the blue LED of one pixel of the plurality of pixels aligned to the one of the plurality of openings.

4. The sign of claim 1, wherein:

the glazing is coated to form the mask.

5. The sign of claim 1, further comprising:

the line of the red LED, the green LED, and the blue LED of each pixel of the plurality of pixels is a straight line.

6. The sign of claim 1, wherein:

the structural return has a second end that runs between at least two of the plurality of printed circuit boards.

7. The sign of claim 1, wherein:

the structural return comprises edges of the mask bending toward the plurality of printed circuit boards.

8. The sign of claim 1, wherein:

each of the plurality of LEDs comprises a 15 degree half width for its light output; and each of the plurality of apertures comprise an aperture width approximately equal to the 15 degree half width for the light output of each of the plurality of LEDs.

9. The sign of claim 1, wherein:

the second pin end is attached directly to the at least one of the plurality of printed circuit boards.

10. A fine pitch full color variable message sign, comprising:

a housing having a front face;

a plurality of printed circuit boards arranged along the front face of the housing;

a plurality of LEDs attached to each of the plurality of printed circuit boards, wherein the plurality of LEDs are grouped into a plurality of pixels, each pixel having at least three LEDs arranged in a line, wherein the at least three LEDs comprise a red LED, a green LED, and a blue LED;

a mask covering the plurality of printed circuit boards, the mask having a plurality of apertures, wherein each pixel is aligned at a different one of the plurality of apertures, such that the red LED, the green LED, and the blue LED of the same pixel are aligned to the same aperture, wherein one of the plurality of apertures has a vertical axis that is greater than a horizontal axis;

a glazing adjacent to the mask located between the mask and the plurality of printed circuit boards; and one or more pins having a first pin end attached to the mask;

wherein:

the glazing obstructs access to the plurality of printed circuit boards and the plurality of LEDs from a front of the sign by covering the plurality of printed circuit boards;

each of the one or more pins extend from the mask and through the glazing; and the one or more pins have a second pin end attached to at least one of the plurality of printed circuit boards.

11. The sign of claim 10, wherein the line of LEDs is oriented vertically in a straight line.

12. The sign of claim 10, wherein the plurality of printed circuit boards are arranged in columns, and the glazing covers each of the columns.

13. The sign of claim 12, further including a plurality of structural returns attached to the mask.

14. The sign of claim 13, wherein:

at least a portion of the plurality of structural returns comprise edges of the mask bending toward the plurality of printed circuit boards.

15. The sign of claim 10, wherein:

the glazing is coated to form the mask.

16. The sign of claim 10, wherein:

the second pin end is attached directly to the at least one of the plurality of printed circuit boards.

17. A fine pitch full color variable message sign, comprising:

a housing;

a printed circuit board inside the housing and having a face parallel with a face of the housing;

a mask covering the printed circuit board, the mask having a plurality of apertures, wherein one of the plurality of apertures has a first axis that is different than a second axis;

a glazing adjacent to the mask and located between the mask and the printed circuit board;

one or more pins having a first pin end attached to the mask; and a plurality of LEDs attached to the printed circuit board, wherein the plurality of LEDs are grouped into a plurality of pixels, each pixel having at least three LEDs arranged in a line, wherein:

the glazing obstructs access to the printed circuit board and the plurality of LEDs from a front of the sign by covering the plurality of printed circuit boards;

each of the one or more pins extend from the mask and through the glazing;

the one or more pins have a second pin end attached to the printed circuit board;

the at least three LEDs comprise a red LED, a green LED, and a blue LED;

and each pixel is aligned at a different one of the plurality of apertures, such that the red LED, the green LED, and the blue LED of the same pixel are aligned to the same aperture.

18. The sign of claim 17, wherein a center of one of the plurality of apertures is offset from a midpoint of the line formed by the at least three LEDs of the plurality of pixels.

19. The sign of claim 17, further comprising:

a structural return comprising edges of the mask bending toward the printed circuit board.

20. The sign of claim 17, wherein:

the glazing is coated to form the mask.

21. The sign of claim 17, wherein:

each of the plurality of LEDs comprises a 15 degree half width for its light output; and each of the plurality of apertures comprise an aperture width approximately equal to the 15 degree half width for the light output of each of the plurality of LEDs.

22. The sign of claim 17, wherein:

the second pin end is attached directly to the printed circuit board.

* * * * *